US010914133B2

(12) United States Patent
Gao et al.

(10) Patent No.: US 10,914,133 B2
(45) Date of Patent: Feb. 9, 2021

(54) SWITCHABLE CROSSOVER TOOL WITH ROTATABLE CHAMBER

(71) Applicant: Halliburton Energy Services, Inc., Houston, TX (US)

(72) Inventors: Bo Gao, Spring, TX (US); Lonnie Carl Helms, Humble, TX (US); Aniruddha Gadre, The Woodlands, TX (US); Yuzhu Hu, Spring, TX (US); Gary Makowiecki, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 73 days.

(21) Appl. No.: 16/318,694

(22) PCT Filed: Sep. 23, 2016

(86) PCT No.: PCT/US2016/053519

§ 371 (c)(1),
(2) Date: Jan. 17, 2019

(87) PCT Pub. No.: WO2018/057009

PCT Pub. Date: Mar. 29, 2018

(65) Prior Publication Data

US 2019/0284914 A1 Sep. 19, 2019

(51) Int. Cl.
*E21B 33/14* (2006.01)
*E21B 33/16* (2006.01)
(Continued)

(52) U.S. Cl.
CPC ..... *E21B 33/14* (2013.01); *E21B 33/16* (2013.01); *E21B 43/045* (2013.01); *E21B 34/06* (2013.01); *E21B 2200/06* (2020.05)

(58) Field of Classification Search
CPC ..... E21B 43/045; E21B 33/14; E21B 33/16; E21B 2200/06; E21B 34/06
See application file for complete search history.

(56) References Cited

U.S. PATENT DOCUMENTS 6,378,609 B1 * 4/2002 Oneal ..... E21B 43/045 166/278
7,857,052 B2 12/2010 Giroux et al.
(Continued)

FOREIGN PATENT DOCUMENTS

| | | |
|---|---|---|
| WO | 03080993 | 10/2003 |
| WO | 2015038119 | 3/2015 |
| WO | 2015038171 | 3/2015 |

OTHER PUBLICATIONS

International Search Report and Written Opinion of PCT Application No. PCT/US2016/053519 dated Jun. 15, 2017: pp. 1-17.

*Primary Examiner* — Michael R Wills, III
(74) *Attorney, Agent, or Firm* — Chamberlain Hrdlicka

(57) ABSTRACT

Switchable crossover tools can include a tool body and a rotatable chamber. The tool body includes a main tool path separable into uphole and downhole tool paths and an auxiliary chamber containing uphole and downhole annular ports. The rotatable chamber is located and rotatable within the auxiliary chamber and forming first and second auxiliary flow paths through the auxiliary chamber. The rotatable chamber is positionable between a conventional circulation mode and a reverse circulation mode. In the conventional circulation mode, the uphole and downhole tool paths are in fluid communication and the uphole and downhole annular ports are in fluid communication through the auxiliary chamber. In the reverse circulation mode, the uphole tool path is in fluid communication with the downhole annular port via the first auxiliary flow path, and the downhole tool path is in fluid communication with the uphole annular port via the second auxiliary flow path.

17 Claims, 7 Drawing Sheets

(51) Int. Cl.
*E21B 43/04* (2006.01)
*E21B 34/06* (2006.01)

(56) References Cited

U.S. PATENT DOCUMENTS

| | | | | |
|---|---|---|---|---|
| 8,695,709 | B2 | 4/2014 | Zimmerman et al. | |
| 2003/0192694 | A1 | 10/2003 | Zachman et al. | |
| 2005/0103495 | A1 | 5/2005 | Corbett | |
| 2006/0231253 | A1* | 10/2006 | Vilela | E21B 43/25 166/278 |
| 2010/0218948 | A1 | 9/2010 | Mickelburgh et al. | |
| 2011/0017469 | A1* | 1/2011 | Malone | E21B 34/14 166/373 |
| 2011/0067861 | A1* | 3/2011 | Clem | E21B 43/045 166/278 |
| 2012/0048562 | A1 | 3/2012 | Zimmerman et al. | |
| 2014/0305662 | A1 | 10/2014 | Giroux et al. | |
| 2016/0024876 | A1* | 1/2016 | Ward | E21B 43/105 166/285 |
| 2016/0222756 | A1* | 8/2016 | Perschke | G05B 19/416 |

* cited by examiner

SWITCHABLE CROSSOVER TOOL WITH ROTATABLE CHAMBER

This section is intended to provide relevant contextual information to facilitate a better understanding of the various aspects of the described embodiments. Accordingly, it should be understood that these statements are to be read in this light and not as admissions of prior art.

In cementing operations carried out in oil and gas wells, a hydraulic cement composition is disposed between the walls of the wellbore and the exterior of a pipe string, such as a casing string, that is positioned within the wellbore. The cement composition is permitted to set in the annulus thereby forming an annular sheath of hardened, substantially impermeable cement therein. The cement sheath physically supports and positions the pipe in the wellbore and bonds the pipe to the walls of the wellbore whereby the migration of fluids between zones or formations penetrated by the wellbore is prevented.

A conventional method of cementing involves pumping the cement composition down through the casing and then up through the annulus. In this method, the volume of cement required to fill the annulus must be calculated. Once the calculated volume of cement has been pumped into the casing, a cement plug is placed in the casing. A drilling mud is then pumped behind the cement plug such that the cement is forced into and up the annulus from the far end of the casing string to the surface or other desired depth. When the cement plug reaches a landing collar, float collar, or float shoe disposed proximate the far end of the casing, the cement should have filled the entire volume of the annulus. At this point, the cement is allowed to cure in the annulus into the hard, substantially impermeable mass.

This method, however, may not be suitable for all wells, as it requires the cement to be pumped at high pressures, which makes it potentially unsuitable for wells with softer formations or formations prone to fracture. Reverse cementing is an alternative cementing method in which the cement composition is pumped directly into the annulus between the casing string and the wellbore. Using this approach, the pressure required to pump the cement to the far end of the annulus is much lower than that required in conventional cementing operations. However, in some wells, liner casing is used to form a part of the well casing. Liner casing does not extend all the way to the wellhead. Rather, liner casing is typically suspended from the bottom of an upper casing segment, requiring a liner hanger. Thus, reverse cementing of the liner casing often requires crossover cementing, in which cement is delivered downhole through a conveyance such as a drill pipe, and then crossed over into the annulus between the liner casing and the wellbore.

BRIEF DESCRIPTION OF THE DRAWINGS

For a detailed description of the embodiments of the invention, reference will now be made to the accompanying drawings in which.

DETAILED DESCRIPTION

The present disclosure provides a crossover tool for enabling reverse circulation cementing in a well with liner casing, and which is switchable back and forth between conventional circulation and reverse circulation as needed to accommodate different stages of the cementing operation. Existing crossover tools for reverse circulation do not provide the ability to switch back to conventional circulation. The present systems and techniques are also applicable to other fluid circulation operations and not limited to cementing. Although the present disclosure uses a cementing operation to illustrate an application of the crossover tool, the cross-over tool can also be used in a variety of other operations in which a material is to be placed downhole or used to displace another material.

Figure 1:
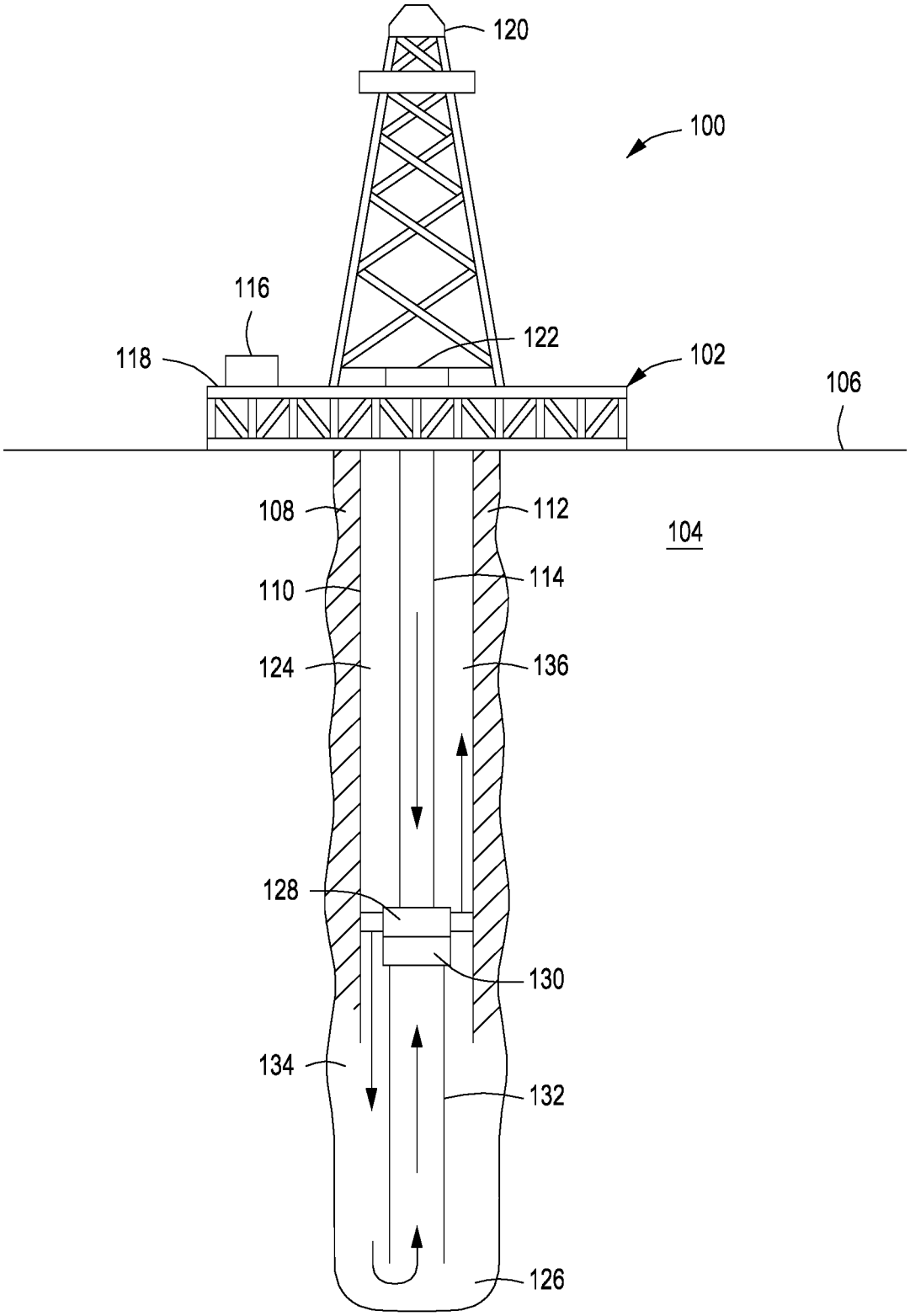
FIG. 1 is a schematic diagram of a well system with liner casing undergoing reverse circulation cementing using a crossover tool in a reverse circulation mode, in accordance with one or more embodiments, in accordance with one or more embodiments.

Referring to the drawings, FIG. 1 depicts a well system 100 with liner casing 132 undergoing reverse circulation using a crossover tool 128, in accordance with one or more embodiments. The system 100 includes a rig 102 centered over a subterranean oil or gas formation 104 located below the earth's surface 106. A wellbore 108 extends through the various earth strata including the formation 104. An upper casing string 110 is located in the wellbore 108 and an annulus 112 is formed between the upper casing string 110 and the wellbore 108. The rig 102 includes a work deck 118 that supports a derrick 120. The derrick 120 supports a hoisting apparatus 122 for raising and lowering pipe strings such as the upper casing string 110. A pump 116 may be located on the work deck 118 and is capable of pumping a variety of fluids, such as cementing material, into the well. The pump 116 may include a pressure sensing means that provides a reading of back pressure at the pump discharge.

A liner casing 132 is suspended within the wellbore 108 extending further downhole from the upper casing string 110. The liner casing 132 is coupled to a liner hanger 130, which is coupled to the crossover tool 128. During a reverse circulation cementing operation, the liner casing 132, the liner hanger 130, and the crossover tool 128 are all suspended from a pipe 114, such as drill pipe, which extends to the surface 106. In one or more embodiments, the liner casing 132 and/or liner hanger 130 may be set to the upper casing string 110 and is at least partially suspended by the upper casing string 110. The crossover tool 128 is configured to separate and direct downhole and uphole flow. Specifically, the crossover tool 128 is switchable between enabling reverse circulation and enabling conventional circulation flow through the wellbore 108.

In one or more embodiments, the upper casing string 110 is cemented prior to cementing the liner casing 132, through conventional or reverse cementing techniques. In certain such embodiments, the wellbore is drilled deeper after cementing the upper casing string 110. The liner casing 132 is then positioned in the additionally formed well depth and cemented via reverse cementing. FIG. 1 illustrates the crossover tool 128 in a reverse circulation mode. As illustrated in FIG. 1, during a reverse cementing operation for cementing liner casing 132, a cementing material is pumped, via the pump 116 located at the surface 106, into the pipe 114. The cementing material travels downhole through the pipe 114 into the crossover tool 128. The cementing material is then directed out of the crossover tool 128 and continues downhole, filling a lower annulus 134 between the liner casing 132 and the wellbore 108 towards well bottom 126, thereby cementing the annulus 134. The fluid return path is uphole through the inside of the liner casing 132, through the liner hanger 130 and into the crossover tool 128. The crossover tool 128 directs the uphole flow into an upper annulus 136 between the pipe 114 and the upper casing string 110 and to the surface 106. The upper annulus 136 between the pipe 114 and the upper casing string 110 is separated from the annulus 134 between the liner casing 132 and the wellbore 108 by the crossover tool 128. The crossover tool 128 provides an internal downhole flow path that couples the pipe 114 and the annulus 134 between the liner casing 132 and the wellbore 108. The crossover tool 128 further provides a separate internal uphole flow path that couples the inside of the liner casing 132 and the upper annulus 136 between the pipe 114 and the upper casing string 110.

Figure 2:
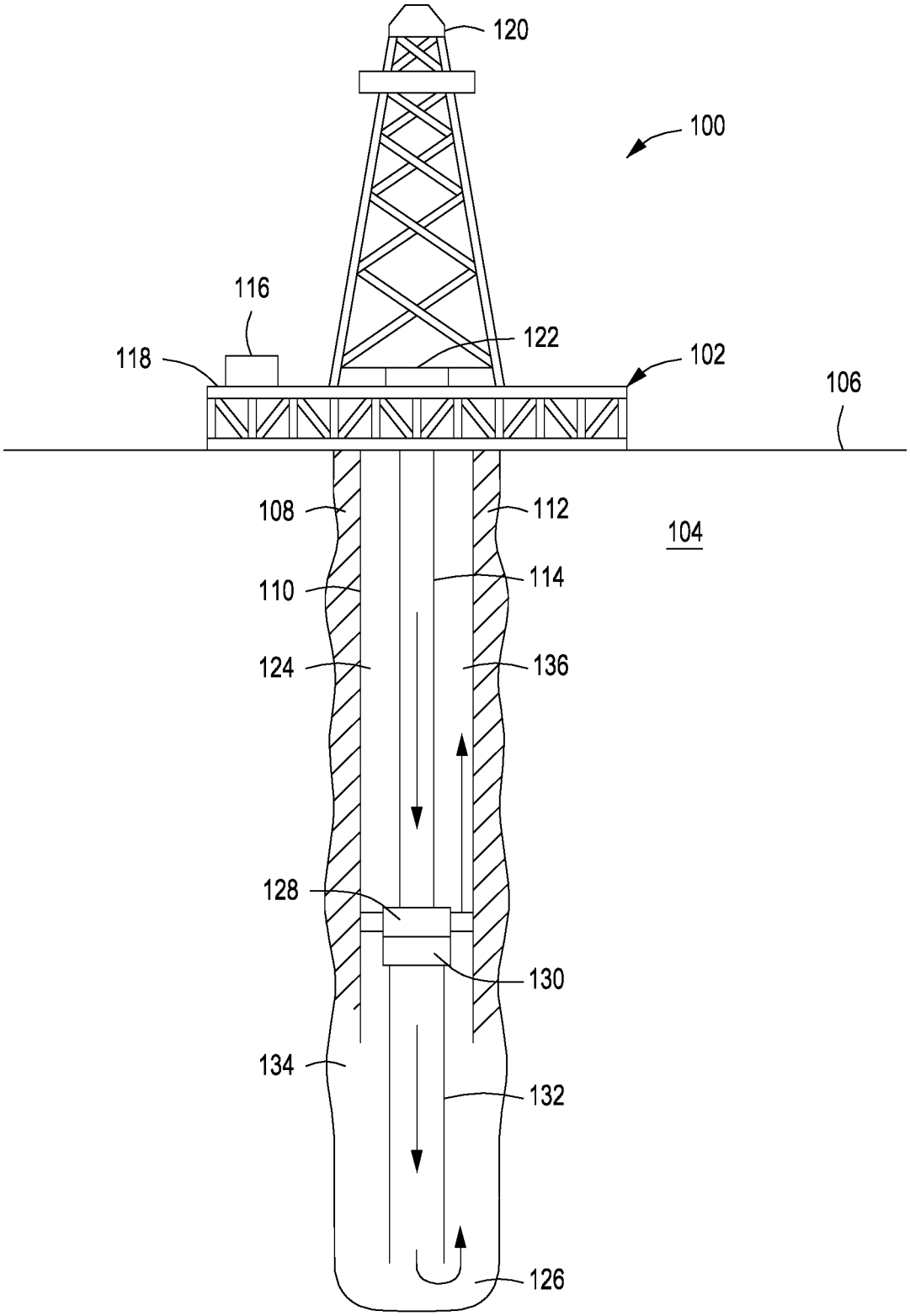
FIG. 2 is a schematic diagram of the well system with the crossover tool in a conventional circulation mode, in accordance with one or more embodiments, in accordance with one or more embodiments.

The crossover tool 128 is switchable between a reverse circulation mode, as illustrated in FIG. 1, and a conventional circulation mode, as illustrated in FIG. 2. Referring to FIG. 2, in the conventional circulation mode, downhole flow is directed downhole through the pipe 114 and through the inside of the liner casing 132 towards well bottom 126, at which point flow is directed uphole through the annulus 134 between the liner casing 132 and the wellbore 108 and further uphole through the annulus between the upper casing string 110 and the pipe 114 to the surface 106.

The wellbore 108 is typically filled with various fluids such as drilling fluid which may be displaced uphole through the uphole return path. Drilling fluid has a different density profile than cementing material. Specifically, drilling fluid typically has a lower density than cementing material. Drilling fluid may be any typical drilling fluid such as a water-based or oil-based drilling fluid. The cementing material used may be or include any typical hydraulic cementitious material that includes calcium, aluminum, silicon, oxygen, sulfur, and/or any mixture thereof and can set and harden by reaction with water. Exemplary hydraulic cementitious materials may be or include, but are not limited to, one or more Portland cements, one or more pozzolana cements, one or more gypsum cements, one or more alumina cements (e.g., high aluminum content cement), one or more silica cements, one or more high alkalinity cements (e.g., pH of about 12 to about 14), one or more resins, or any mixture thereof. In some embodiments, one or more resins may be used in place of cement or in combination with cement.

The crossover tool 128 can be switched back and forth between the conventional circulation mode and the reverse circulation mode multiple times as needed. The internal flow path management and other aspects of the crossover tool 128 are described in further detail below with respect to FIGS. 3-8.

Figure 3:
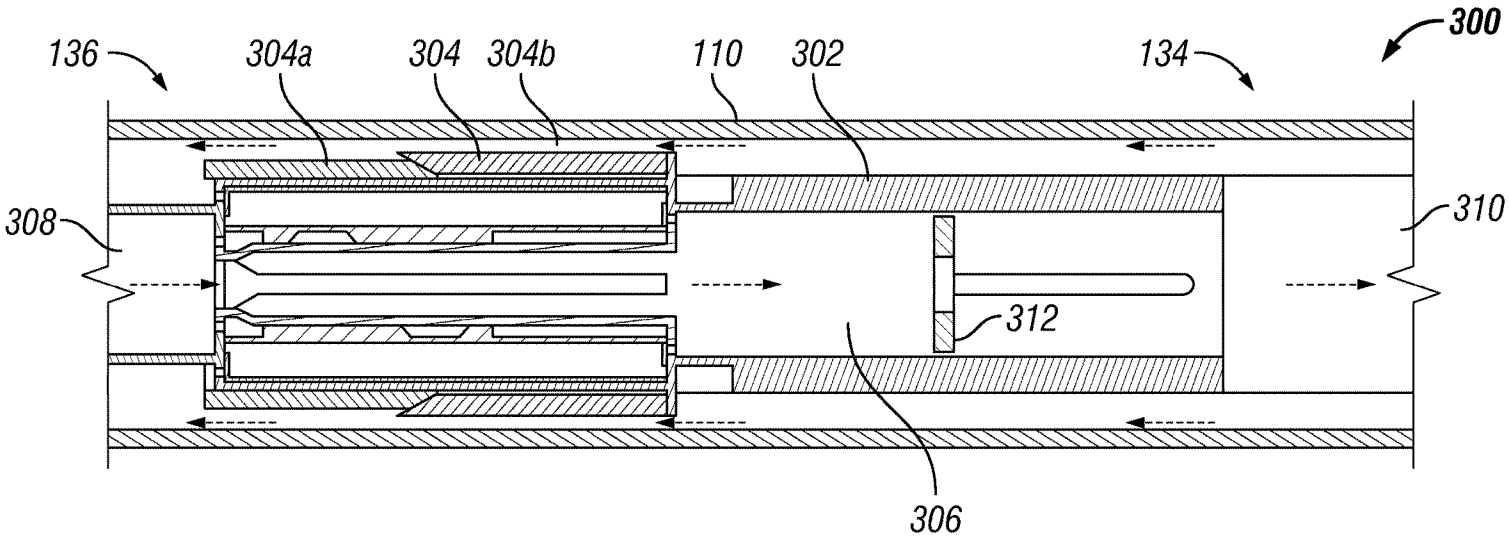
FIG. 3 is a schematic diagram a crossover tool in an initial run-in state, in accordance with one or more embodiments.

FIGS. 3-8 illustrate a crossover tool 300, such as can be used as crossover tool 128, in various operational states, including the abovementioned conventional circulation mode and reverse circulation mode, in accordance with one or more embodiments. FIG. 3 illustrates the crossover tool 300 in an initial run-in state. The tool 300 is run downhole through the upper casing string 110 in such a state. The tool 300 includes a tool body 302 having an uphole end 308 and a downhole end 310. The uphole end 308 may be coupled to a conveyance such as pipe 114 (FIG. 1). The downhole end 310 may be coupled to liner casing 132 via liner hanger 130 (FIG. 1). The tool body 302 includes an internal main tool path 306 and an external packer 304. The external packer 304 is located on the outside of the crossover tool 300 and within the upper casing string 110. The external packer 304 is in an unactuated position when the crossover tool 300 is in the initial run-in state illustrated in FIG. 3, in which there is space between the packer 304 and the upper casing string 110 permitting fluid flow therethrough. In the initial run-in state, the main tool path 306 is open and couples the uphole end 308 of the body 302 to the downhole end 310. Thus, in the initial run-in position, the crossover tool 300 is in a conventional circulation mode, in which a downhole flow path is established through the crossover tool 300 between the pipe 114 and the liner casing 132. In the initial run-in position, the presence of the crossover tool 300 is functionally negligible.

Figure 4:
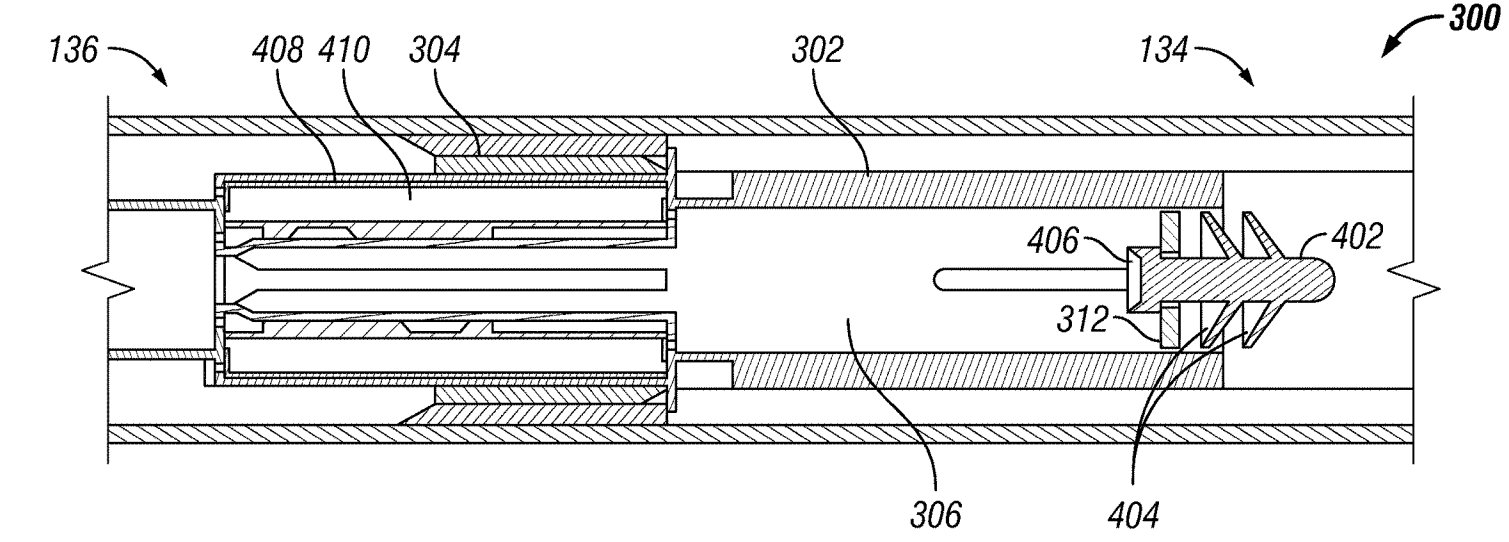
FIG. 4 is a schematic diagram of the crossover tool with a packer actuated, in accordance with one or more embodiments.

The packer sleeve 304 is coupled to a packer slider 312 such that when a packer slider 312*a* is moved towards the downhole end 310, the packer sleeve 304*b* is pulled downward as well, setting the packer 304. FIG. 4 illustrates the crossover tool 300 with the packer 304 actuated or set, in which the packer 304 expands to form a seal between the crossover tool 300 and the upper casing string 110, thereby separating upper annulus 136 from lower annulus 134 (FIG. 1).

With reference to FIG. 4, the packer slider 312 is located within the main tool path 306 and moved downward by a packer dart 402 travelling downhole through the main tool path 306. In one or more embodiments, the slider 312 includes a biasing element such as a surface or protrusion such that the packer dart 402 catches the biasing element as it travels downhole, and pulling the slider 312 downward. A pressure is applied to the packer dart 402 from the surface to push it downhole and to move packer dart 402. In one or more embodiments, the packer dart 402 includes a sealing feature or abutment 406 which seals against the main tool path 306, enabling the pressure differential needed for the packer dart 402 to push the slider 312 downward and set the packer 304. The abutment feature 406 can be used for catching and pulling the packer dart 402 downhole. The abutment 406 can be or include, but is not limited to, a sealing feature, a dart seat, a ring, a shear ring, or any combination thereof.

Figure 5:
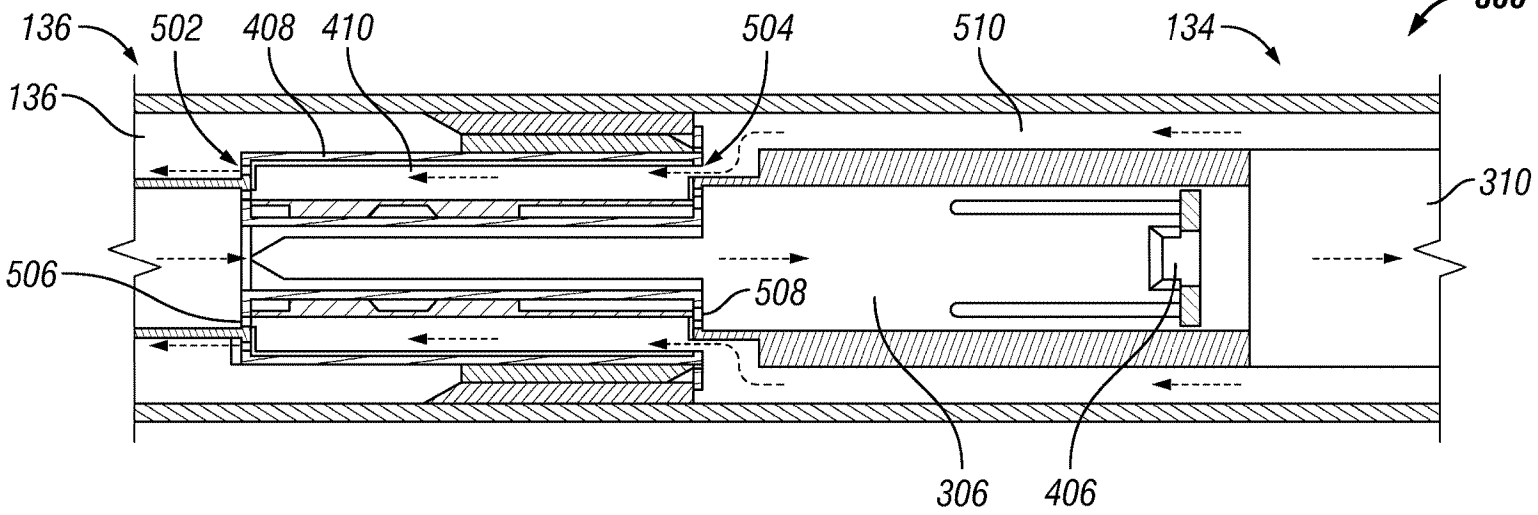
FIG. 5 is a schematic diagram of the crossover tool in a conventional circulation mode, in accordance with one or more embodiments.

FIG. 5 shows the crossover tool 300 in the conventional circulation mode. In order to enable fluid circulation through the crossover tool 300, the packer dart 402 is removed from the main tool path 306, as illustrated in FIG. 5. Specifically, the packer dart 402 may be removed by increasing the pressure uphole of the packer dart 402 to push the packer dart 402 downhole, ejecting it from the main tool path 306.

In one or more embodiments, the increased pressure causes the packer dart 402 to separate from the abutment feature 406, so that the packer dart 402 is ejected from the main tool path 306, leaving the abutment feature 406 behind on the packer slider 312. In certain such embodiments, the abutment feature 406 may be a shear ring configured to shear or detach from the body of the packer dart 402. The abutment feature includes an orifice such that fluid can still flow through the main tool path 306. Thus, in the conventional circulation mode, the main tool path 306 is open.

The tool body 302 also includes an auxiliary chamber 408 configured to facilitate various flow paths through the crossover tool 300. In one or more embodiments, the crossover tool 300 further includes a rotatable chamber 410 located within the auxiliary chamber 408. The rotatable chamber 410 is rotatable with respect to the auxiliary chamber 408 to control and direct flow through the auxiliary chamber 408.

In one or more embodiments, the auxiliary chamber 408 includes an upper annular port 502, a lower annular port 504, an upper tool port 506, and a lower tool port 508. The upper annular port 502 couples the auxiliary chamber 408 to upper annulus 136. The lower annular port 504 couples the auxiliary chamber 408 to lower annulus 134. The upper tool port 506 and the lower tool port 508 both couple the auxiliary chamber 408 to main tool path 306. The rotatable chamber 408 is rotatable to open and close these ports to selectively establish and switch between conventional circulation flow paths and reverse circulation flow paths through the crossover tool 300.

In the conventional circulation mode, the rotatable chamber 410 is positioned such that the upper and lower annulus ports 502, 504 are open and in fluid communication through the auxiliary chamber 408. However, upper and lower tool ports 506, 508 are closed or blocked by the rotatable chamber 410 so fluid traveling through the main tool path 306 does not enter the auxiliary chamber 408. Thus, in the conventional circulation mode, fluid is injected downhole via the main tool path 306 and returns uphole through the lower annulus 134, into the auxiliary chamber 408 via the lower annulus port 504, out of the auxiliary chamber 408 and into the upper annulus 136 via the upper annulus port 502. In other words, the auxiliary chamber 408, having both upper and lower annulus ports 502, 504 open, connects the lower annulus 134 to the upper annulus 136, and permits fluid to return uphole therethrough. Thus, conventional circulation is established through the crossover tool 300.

In one or more embodiments, in the initial position, the lower annular port 504 may be covered by an outer sleeve 510 on the outside of the tool body 302. The outer sleeve 408 may be mechanically coupled to the packer slider 312 such that the outer sleeve 408 is moved downward when the packer dart 402 moves the slider 312, thereby exposing the lower annular port 504, as shown in FIG. 5

Figure 6:
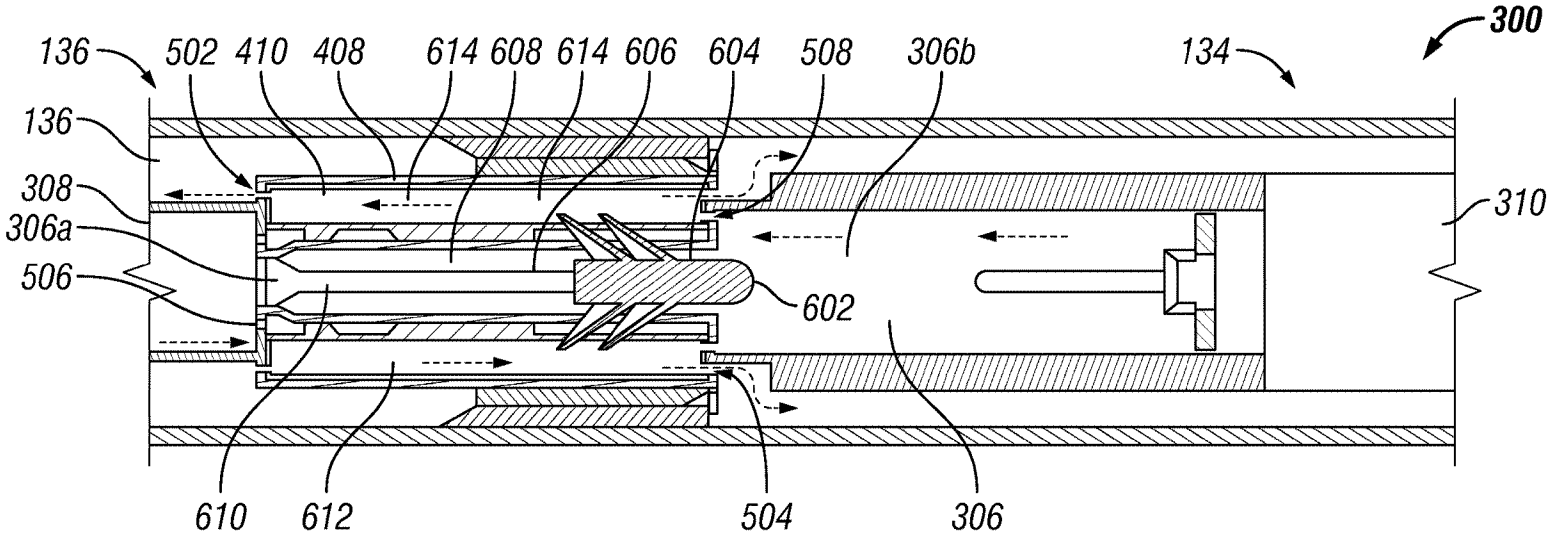
FIG. 6 is a schematic diagram of the crossover tool in a reverse circulation mode, in accordance with one or more embodiments.

FIG. 6 illustrates the crossover tool 300 in a reverse circulation mode. In order to establish reverse circulation, an activation dart 602 is launched downhole into the main tool path 306. In one or more embodiments, the activation dart 602 includes one or more pins 604, shown more clearly in FIG. 7, configured to enter a slot feature 606 formed in an internal wall 608 surrounding the main tool path 306, the wall 608 separating the main tool path 306 from the auxiliary chamber 408. The pin 604 of the activation dart 602 extends through the slot feature 606 and also engages a groove feature 610 of the rotatable chamber 410 located within the auxiliary chamber 408. In one or more embodiments, the groove feature 610 has a helical shape. Thus, the rotatable chamber 410 rotates in response to the pin 604 traversing the helical groove 610 by guided by the straight slot feature 606. Specifically, the rotatable chamber 410 is rotated into a reverse circulation position. The activation dart 602 stops when it reaches the end of the slot feature 606 and remains within the main tool path 306. The activation dart 602 also includes seals 611 which seal the main tool path 306 while the dart 602 is positioned therein. Thus, during the reverse circulation mode, the main tool path 306 is separated into an upper tool path 306 a uphole of the dart 602 and a lower tool path 306 *b* downhole of the dart 602, and the uphole end 308 separated from the downhole end 310. The activation dart 602 acts as a plug or may be replaced by a different plug form.

The rotatable chamber 410 includes at least two isolated compartments that establish a first auxiliary flow path 612 and a second auxiliary flow path 614 within the auxiliary chamber 408. When the rotatable chamber 410 is in the reverse circulation position, the upper tool port 560 and lower annular port 508 are open and coupled via the first auxiliary flow path 612, thereby placing the upper flow path 306*a* in fluid communication with the lower annulus 134 and forming a downhole flow path therethrough. Likewise, when the rotatable chamber is 410 is in the reverse circulation position, the upper annular port 502 and the lower tool port 508 are open and coupled via the second auxiliary path 614, thereby placing the lower tool path in fluid communication with the upper annulus 136 and forming an uphole flow path therethrough. Thus, when cement (or other fluid) is injected downhole through a pipe 114 (FIG. 1), the cement flows into the upper tool path 306*a* of the crossover tool 300 and into the first auxiliary flow path 612 and out of the crossover tool 300 into the lower annulus 134 between the liner 132 and the wellbore 108, thereby cementing the liner 132 in a reverse cementing fashion. Accordingly, the return fluid is displaced uphole into the liner 132 and into the lower tool path 306*b* of the crossover tool 300, into the second auxiliary path 614, and then crossed over to the upper annulus 136. The downhole flow path is thus isolated from the uphole flow path.

Figure 7:
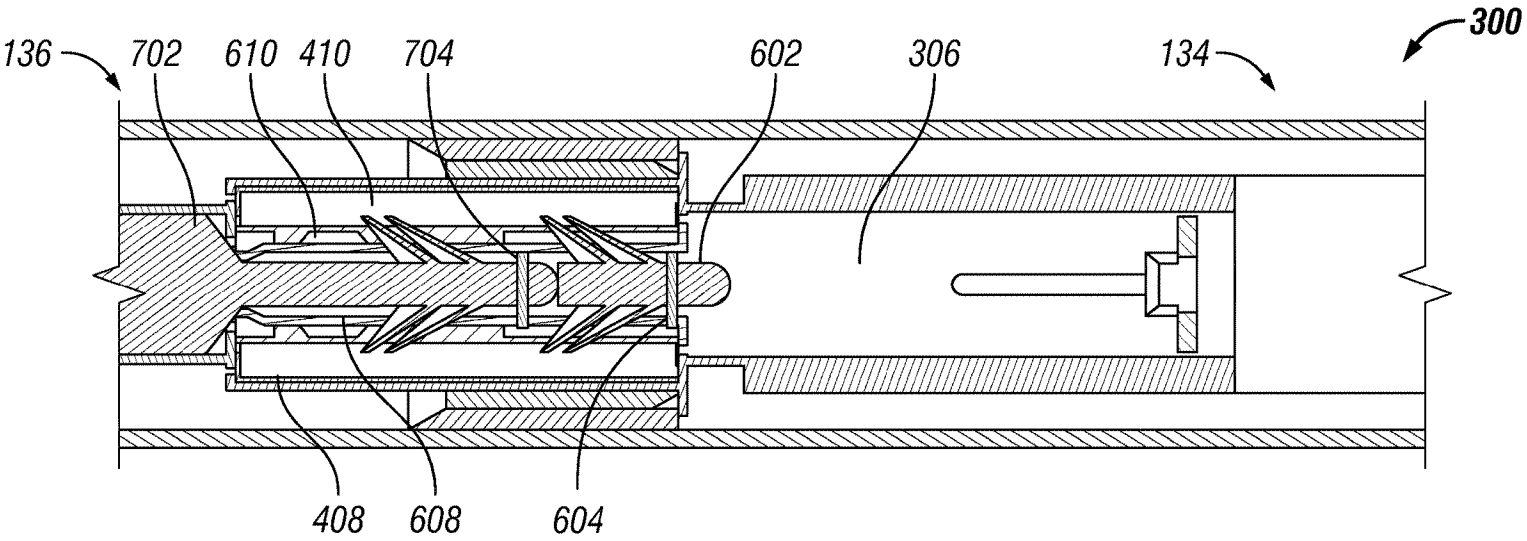
FIG. 7 is a schematic diagram of the crossover tool being set back to the conventional circulation mode, in accordance with one or more embodiments.

FIG. 7 illustrates switching of the crossover tool 300 from the reverse circulation mode to the conventional circulation mode. The crossover tool 300 can be switched back to the conventional flow mode by rotating the rotatable chamber 410 back into the conventional circulation position and removing the activation dart 602 from the main tool path 306. In one or more embodiments, a deactivation dart 702 is launched into the main tool path 306 of the crossover tool 300 from the surface. Similar to the activation dart 602, the deactivation dart 702 also includes pins 704 configured to enter the slot feature 606 (FIG. 6) formed in the internal wall 608 of the main tool path 306 and also engages the groove feature 610 of the rotatable chamber 410 located within the auxiliary chamber 408. As the deactivation dart 702 travels down the main tool path, guided by the slot, the rotatable chamber 410 is rotated back into the conventional circulation position.

Figure 8:
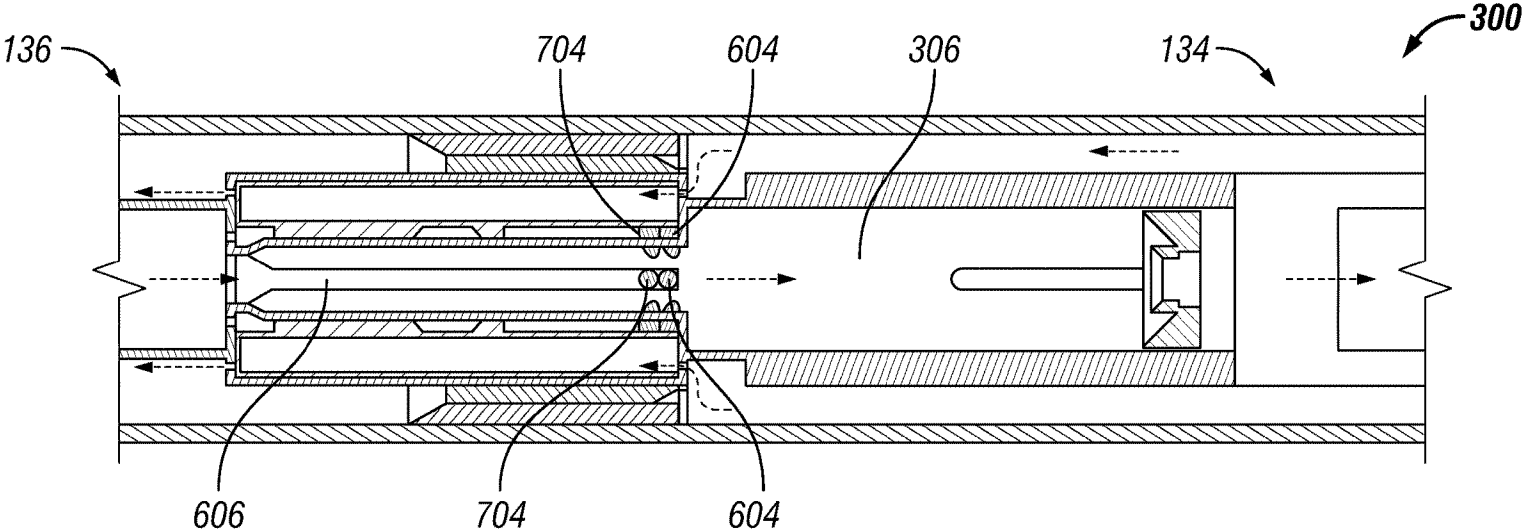
FIG. 8 is a schematic diagram of the crossover tool in the conventional circulation mode after being in the reverse circulation mode, in accordance with one or more embodiments.

In one or more embodiments, as illustrated in FIG. 8, an increased pressure is applied on the deactivation and activation darts 602, 702, shearing the pins 604 of the darts 602, 702 and ejecting the darts 602, 702 downhole and out of the crossover tool 300, thereby opening the main tool path 306. FIG. 8 illustrates the crossover tool 300 in the conventional circulation mode, in which the pins 704, 604 of the deactivation and activation darts 702, 602 have been sheared and remain in the slots 606. As described above with respect to FIG. 5, in the conventional circulation mode, fluid is injected downhole through the main tool path 306 and returns uphole via the lower annulus 134, through the auxiliary chamber 408 of the crossover tool 300, and into the upper annulus 136.

The crossover tool 300 can be switched back and forth between the conventional and reverse circulation modes by repeating the steps illustrated in FIGS. 6-8, leaving behind additional sheared pins 704, 604 with each iteration. In one or more embodiments, the number of switches is limited by the number of pins that can be stacked in the slots 606, which can be taken into consideration when designing the crossover tool 300.

Figure 9:
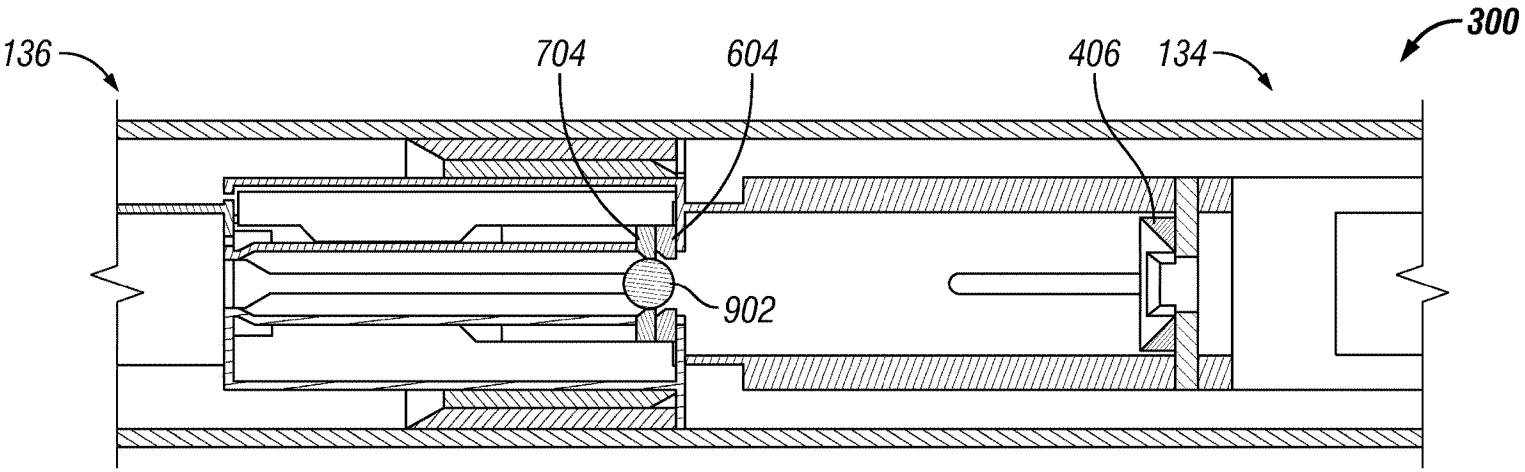
FIGS. 9 and 10 are schematic diagrams of the crossover tool facilitating a ball drop to set a liner hanger, in accordance with one or more embodiments.
Figure 10:
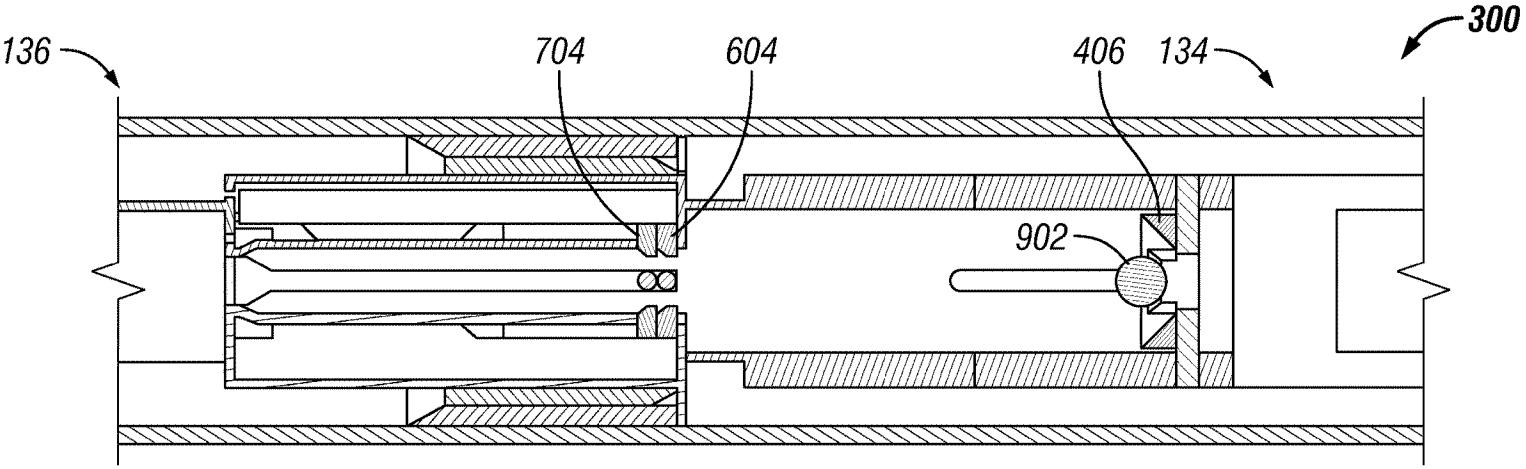

In one or more applications of the crossover tool 300, the liner hanger 130 coupled downhole of the crossover tool 300 may need to be activated after the liner 132 is cemented. In one or more embodiments, a ball drop is required to activate the liner hanger 130. FIGS. 9 and 10 illustrate such a ball 902 travelling through the crossover tool 300. Specifically, the ball travels past the sheared pins 704, 604, which have angled faces, allowing them to be pushed outward as the ball 902 travels past, as illustrated in FIG. 9. The ball then travels through the dart seat 406, as illustrated in FIG. 10. The dart seat 406 is configured to expand for the ball 902 to fit therethrough.

Figure 11:
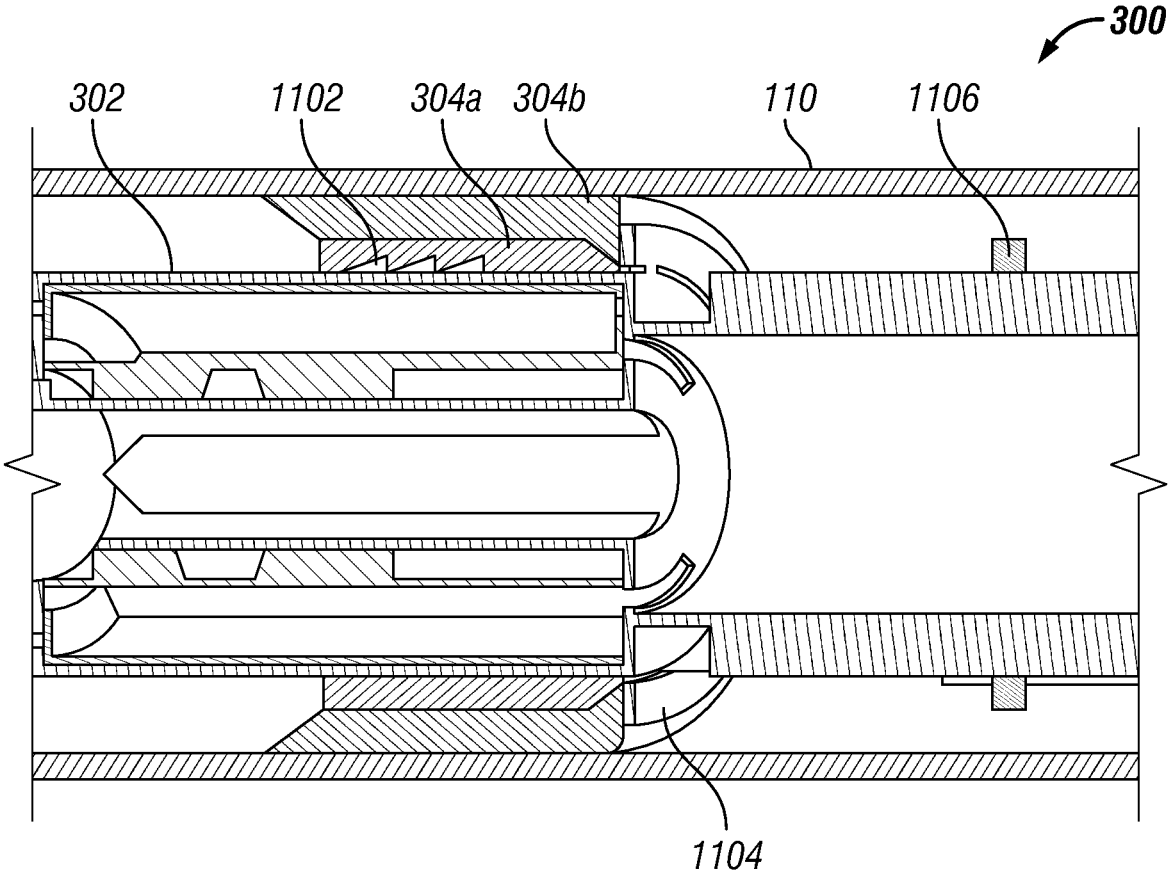
FIG. 11 is a schematic diagram of the crossover tool illustrating features that facilitate pulling the crossover tool out of hole, in accordance with one or more embodiments.

FIG. 11 illustrates elements of the crossover tool 300 that facilitate pulling the crossover tool 300 out of hole. When pulling out of hole, the packer sleeve 304*a* is coupled to the tool body 302 via a saw tooth element 1102 and pulled uphole with the tool body 302. However, the packer body 304*b* may retain on the casing wall 110 due to frictional force between the packer body 304*b* and the casing 110. Thus, as the tool body 302 is moved uphole relative to the packer body 304*b*, a block ring 1104 shears from the tool body 302 and the packer sleeve 304*a* is lifted out of the packer body 304*b*. The packer body 304*b* can then collapse and move with respect to the casing 110. The packer body 304*b* and block ring 1104 are then caught by a stopper 1106 on a lower portion of the tool body 302 and lifted uphole with the tool body 302, thereby pulling all crossover tool 300 elements out of hole.

In addition to the embodiments described above, embodiments of the present disclosure further relate to one or more of the following paragraphs:

1. A switchable crossover tool, comprising: a tool body comprising: a main tool path separable into an uphole tool path and a downhole tool path; and an auxiliary chamber comprising an uphole annular port and a downhole annular port; and a rotatable chamber located and rotatable within the auxiliary chamber and forming a first auxiliary flow path and a second auxiliary flow path through the auxiliary chamber, wherein the rotatable chamber is positionable between: a conventional circulation mode, wherein the uphole tool path and the downhole tool path are in fluid communication, and the uphole annular port and the downhole annular port are in fluid communication through the auxiliary chamber; and a reverse circulation mode, wherein the uphole tool path is in fluid communication with the downhole annular port via the first auxiliary flow path, and the downhole tool path is in fluid communication with the uphole annular port via the second auxiliary flow path.

2. A switchable crossover system for reverse cementing, comprising: a switchable crossover tool coupled between a conveyance and a casing segment located within a well, the switchable crossover tool comprising: a tool body comprising: a main tool path; and an auxiliary chamber; and a rotator coupled to and rotatable with respect to the tool body to direct flow through the switchable crossover tool, wherein the rotator is rotatable between a conventional circulation mode and a reverse circulation mode; wherein in the conventional circulation mode, the conveyance is in fluid communication with the casing segment via the switchable crossover tool; and wherein in the reverse circulation mode, the conveyance is in fluid communication with a downhole annulus between the casing segment and the well via the switchable crossover tool.

3. The tool or the system of paragraph 1 or 2, wherein rotation of the rotatable chamber is driven by a dart.

4. The tool or the system according to any one of paragraphs 1-3, wherein the uphole tool path is separated from the downhole tool path by the dart.

5. The tool or the system according to any one of paragraphs 1-4, further comprising an actuatable packer located on the tool body and configured to separate the uphole annular port from the downhole annular port.

6. The tool or the system according to any one of paragraphs 1-5, wherein the actuatable packer is actuated by a packer dart.

7. The tool or the system according to any one of paragraphs 1-6, further comprising an uphole end and a downhole end, wherein the uphole end is configured to couple to a conveyance and the downhole end is configured to couple to a casing segment or casing hanger.

8. The tool or the system according to any one of paragraphs 1-7, wherein the switchable crossover tool further comprises an annular packer located between the tool body and the well, separating an uphole annulus uphole of the annular packer from the downhole annulus downhole of the annular packer.

9. The tool or the system according to any one of paragraphs 1-8, wherein in the conventional circulation mode, the conveyance is in fluid communication with the casing segment via the main tool path and the downhole annulus is in fluid communication with the uphole annulus via the auxiliary chamber.

10. The tool or the system according to any one of paragraphs 1-9, wherein in the reverse circulation mode, the conveyance is in fluid communication with the downhole annulus and the casing segment is in fluid communication with the uphole annulus.

11. The tool or the system according to any one of paragraphs 1-10, wherein the auxiliary chamber comprises a first auxiliary path and a second auxiliary path, and in the reverse circulation mode, the conveyance is in fluid communication with the downhole annulus via the first auxiliary path and the casing segment is in fluid communication with the uphole annulus via the second auxiliary path.

12. The tool or the system according to any one of paragraphs 1-11, wherein rotation of the rotator is driven by a dart.

13. The tool or the system according to any one of paragraphs 1-12, wherein the rotator is rotatable from the conventional circulation mode into the reverse circulation mode by an activation dart and the rotator is rotatable from the reverse circulation mode to the conventional circulation mode by a deactivation dart, wherein the deactivation dart is configured to traverse the entire main tool path, thereby ejecting the activation dart from the main tool path.

14. A method of reverse cementing a well having a borehole wall with the tool or the system according to any one of paragraphs 1-13.

15. A method of reverse cementing a well having a borehole wall, comprising: setting a packer in an annulus between a crossover tool and the borehole wall, wherein the packer separates the annulus into an uphole annulus and a downhole annulus; separating a main tool path of the crossover tool into an uphole tool path and a downhole tool path; and rotating a rotator of the crossover tool into a reverse circulation mode, putting the uphole tool path is put in fluid communication with the downhole annulus through a first auxiliary path of the crossover tool and the downhole tool path is put in fluid communication with the uphole annulus through a second auxiliary path of the crossover tool.

16. The method of paragraph 14 or 15, further comprising launching an activation dart into the main tool path to rotate the rotator into the reverse circulation mode.

17. The method according to any one of the paragraphs 14-16, wherein the activation dart separates the main tool path into the uphole tool path and the downhole tool path.

18. The method according to any one of the paragraphs 14-17, further comprising: rejoining the uphole tool path and the downhole tool path; and rotating the rotator into a conventional circulation mode, wherein the downhole annulus is placed in fluid communication with the uphole annulus via an auxiliary chamber of the crossover tool.

19. The method according to any one of the paragraphs 14-18, wherein the first and second auxiliary paths are located within the auxiliary chamber.

20. The method according to any one of the paragraphs 14-19, wherein placing the crossover tool in reverse circulation mode further comprises: forming a downhole flow path through the uphole tool path and the downhole annulus; and forming an uphole flow path through the downhole tool path and the uphole annulus.

21. The method according to any one of the paragraphs 14-20, further comprising rotating the rotator into conventional circulation mode which comprises: forming a downhole flow path through the main tool path; and forming an uphole flow path through the downhole annulus, the auxiliary chamber, and the uphole annulus.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A switchable crossover tool, comprising:

a tool body comprising: a main tool path separable into an uphole tool path and a downhole tool path; and an auxiliary chamber comprising an uphole annular port and a downhole annular port; and a rotatable chamber located and rotatable within the auxiliary chamber and forming a first auxiliary flow path and a second auxiliary flow path through the auxiliary chamber, wherein the rotatable chamber is positionable between: a conventional circulation mode, wherein the uphole tool path and the downhole tool path are in fluid communication, and the uphole annular port and the downhole annular port are in fluid communication through the auxiliary chamber; and a reverse circulation mode, wherein the uphole tool path is in fluid communication with the downhole annular port via the first auxiliary flow path, and the downhole tool path is in fluid communication with the uphole annular port via the second auxiliary flow path.

2. The tool of claim 1, wherein rotation of the rotatable chamber is driven by a dart.

3. The tool of claim 2, wherein the uphole tool path is separated from the downhole tool path by the dart.

4. The tool of claim 1, further comprising an actuatable packer located on the tool body and configured to separate the uphole annular port from the downhole annular port.

5. The tool of claim 4, wherein the actuatable packer is actuated by a packer dart.

6. The tool of claim 5, further comprising an uphole end and a downhole end, wherein the uphole end is configured to couple to a conveyance and the downhole end is configured to couple to a casing segment or casing hanger.

7. A switchable crossover system for reverse cementing, comprising:

a switchable crossover tool coupled between a conveyance and a casing segment located within a well, the switchable crossover tool comprising:

a tool body comprising:

a main tool path; and an auxiliary chamber comprising a first auxiliary path and a second auxiliary path; and a rotator coupled to and rotatable with respect to the tool body to direct flow through the switchable crossover tool, wherein the rotator is rotatable between a conventional circulation mode and a reverse circulation mode; wherein in the conventional circulation mode, the conveyance is in fluid communication with the casing segment via the switchable crossover tool; and wherein in the reverse circulation mode, the conveyance is in fluid communication with a downhole annulus between the casing segment and the well via the first auxiliary path and the casing segment is in fluid communication with the uphole annulus via the second auxiliary path.

8. The system of claim 7, wherein the switchable crossover tool further comprises an annular packer located between the tool body and the well, separating an uphole annulus uphole of the annular packer from the downhole annulus downhole of the annular packer.

9. The system of claim 8, wherein in the conventional circulation mode, the conveyance is in fluid communication with the casing segment via the main tool path and the downhole annulus is in fluid communication with the uphole annulus via the auxiliary chamber.

10. The system of claim 7, wherein rotation of the rotator is driven by a dart.

11. The system of claim 10, wherein the rotator is rotatable from the conventional circulation mode into the reverse circulation mode by an activation dart and the rotator is rotatable from the reverse circulation mode to the conventional circulation mode by a deactivation dart, wherein the deactivation dart is configured to traverse the entire main tool path, thereby ejecting the activation dart from the main tool path.

12. A method of reverse cementing a well having a borehole wall, comprising:

setting a packer in an annulus between a crossover tool and the borehole wall, wherein the packer separates the annulus into an uphole annulus and a downhole annulus;

separating a main tool path of the crossover tool into an uphole tool path and a downhole tool path;

launching an activation dart into the main tool path to rotate the rotator into the reverse circulation mode; and rotating a rotator of the crossover tool into a reverse circulation mode, putting the uphole tool path is put in fluid communication with the downhole annulus through a first auxiliary path of the crossover tool and the downhole tool path is put in fluid communication with the uphole annulus through a second auxiliary path of the crossover tool.

13. The method of claim 12, wherein the activation dart separates the main tool path into the uphole tool path and the downhole tool path.

14. The method of claim 12, further comprising: rejoining the uphole tool path and the downhole tool path; and rotating the rotator into a conventional circulation mode, wherein the downhole annulus is placed in fluid communication with the uphole annulus via an auxiliary chamber of the crossover tool.

15. The method of claim 14, wherein the first and second auxiliary paths are located within the auxiliary chamber.

16. The method of claim 14 further comprising rotating the rotator into conventional circulation mode which comprises: forming a downhole flow path through the main tool path; and forming an uphole flow path through the downhole annulus, the auxiliary chamber, and the uphole annulus.

17. The method of claim 12, wherein placing the crossover tool in reverse circulation mode further comprises: forming a downhole flow path through the uphole tool path and the downhole annulus; and forming an uphole flow path through the downhole tool path and the uphole annulus.

* * * * *